United States Patent [19]

Mijares, Jr. et al.

[11] 4,039,104

[45] Aug. 2, 1977

[54] WALL MOUNTED MULTIPLE-UNIT DISPENSER WITH ROTARY DISCHARGE ASSISTANTS

[75] Inventors: John Anthony Mijares, Jr., Miami Lakes; Ross J. Petrie, Fort Lauderdale; John Anthony Mijares, Sr., Miami Lakes; Charles S. Alvarez, Hialeah, all of Fla.

[73] Assignee: Anthony J. Mijares, Jr., Miami Lakes, Fla.

[21] Appl. No.: 687,249

[22] Filed: May 17, 1976

[51] Int. Cl.[2] ..... B67D 5/60; B67D 5/32

[52] U.S. Cl. ..... 222/144.5; 222/181; 248/221.3; 248/313

[58] Field of Search ..... 248/221.3, 311.1, 313; 222/129, 144.5, 181, 131

[56] References Cited

U.S. PATENT DOCUMENTS

| | | | |
|---|---|---|---|
| 2,450,722 | 10/1948 | Drije | 248/311.1 |
| 2,971,678 | 2/1961 | Cazeneuve | 222/131 |
| 3,540,630 | 11/1970 | Brown et al. | 222/181 X |
| 3,844,444 | 10/1974 | Carroll | 248/311.1 X |
| 3,902,637 | 9/1975 | Scheeler | 222/144.5 |

*Primary Examiner*—Robert B. Reeves
*Assistant Examiner*—David A. Scherbel
*Attorney, Agent, or Firm*—Oltman and Flynn

[57] ABSTRACT

A multiple-unit dispenser is disclosed including two side-by-side containers having mouths at their upper ends and openings at their lower ends, with a valve at each of the openings for controlling the dispensing of liquid products. A single unitary lid covers both the mouths at the tops of the containers. The containers are both parts of a single, unitary housing which is mounted on a wall bracket. Preferably, the wall bracket has upper and lower fingers which grasp the housing, and the lid has a downwardly extending projection which retains the upper finger of the bracket so that the upper finger cannot be released without removing the lid, thereby locking the housing on the wall bracket.

7 Claims, 8 Drawing Figures

WALL MOUNTED MULTIPLE-UNIT DISPENSER WITH ROTARY DISCHARGE ASSISTANTS

BACKGROUND OF THE INVENTION

A typical multiple-unit dispenser of the prior art is shown in U.S. Pat. No. 2,971,678. That unit is designed to dispense liquid from one container and pulverant material from two other containers. The containers have spouts at their bottoms which are offset vertically in a stepped manner to provide access to each of the spouts.

SUMMARY OF THE INVENTION

The present invention is a multiple-unit dispenser including at least two side-by-side containers formed in an integral housing provided with a unitary lid for closing the filling mouths at the tops of both of the containers. The housing is mounted on a wall bracket which has an upper spring finger for grasping an upper portion of the housing. The lid of the container has a downwardly extending projection for engaging the upper spring finger to prevent release of that finger from the housing without removing the lid from the housing. A lower spring finger of the bracket grasps a lower portion of the housing.

It is an object of the present invention to provide an improved multiple-unit dispenser for dispensing at least two different liquid products such as shampoo and cream rinse.

Another object of the invention is to provide a multiple-unit dispenser with a unitary housing which may be molded from plastic.

Another object of the invention is to provide a multiple-unit dispenser for liquids with a rotary valve at the bottom of each container of the dispenser.

Another object of the invention is to provide a multiple-unit dispenser with a wall bracket which locks relative to the dispenser to keep the dispenser securely fastened to the wall.

Further objects and advantages of this invention will be apparent from the following detailed description of a presently-preferred embodiment thereof, which is shown in the accompanying drawings.

DETAILED DESCRIPTION

Figure 1:
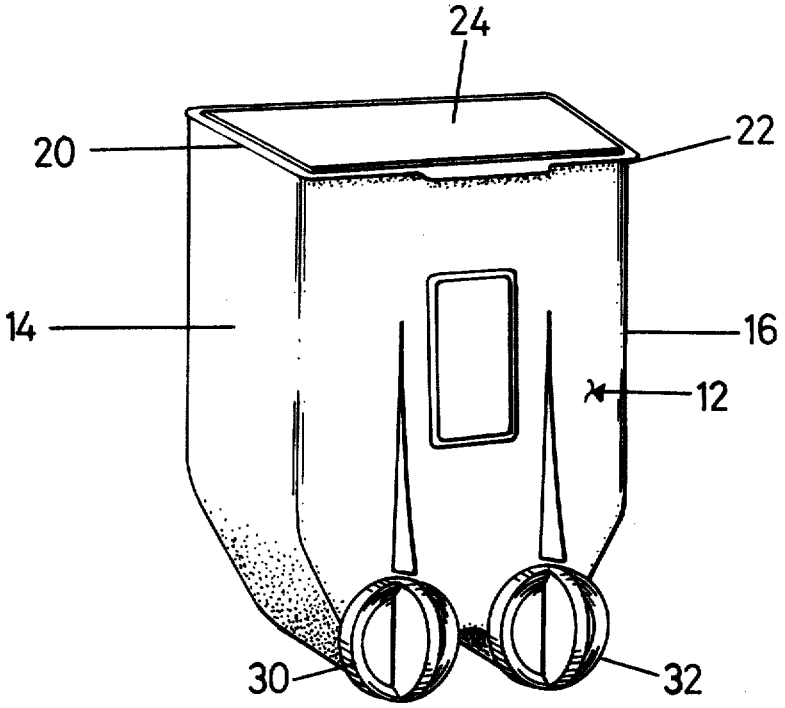
FIG. 1 is a perspective view of a multiple-unit dispenser in accordance with a preferred embodiment of the invention.
Figure 2:
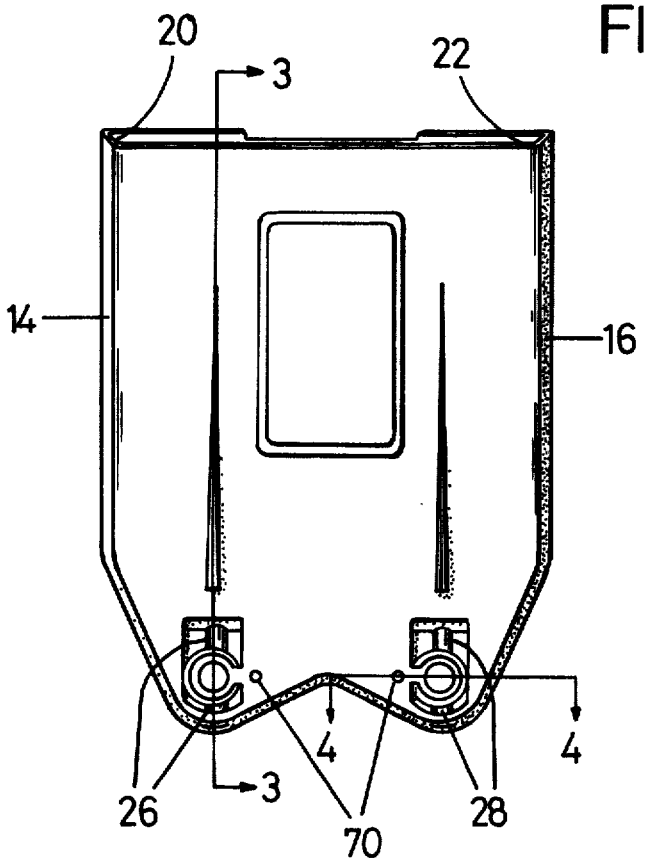
FIG. 2 is an elevational view of a housing included in the dispenser FIG. 1.

The multiple-unit dispenser includes an integral housing 12 that forms two side-by-side containers 14 and 16 separated by a partition 18. The containers 14 and 16 have mouths 20 and 22 at their upper ends. Both of these mouths are closed by a removable lid 24 that fits over the mouths at the top of the housing 12. The lid 24 has a depressed rim 25 for engaging the inside of the mouths to retain the lid laterally. The lid could be hinged or otherwise retained if desired.

The containers 14 and 16 have openings 26 and 28 at the bottoms thereof and leading into the insides of the respective containers 14 and 16. A pair of rotary valves designated generally 30 and 32 are provided in sleeves such as 27 at the openings 26 and 28 at the bottom of the containers 14 and 16 for opening and closing the openings 26 and 28 to control the dispensing of liquid products from the containers 14 and 16.

The multiple-unit dispenser is particularly designed to dispense liquid shampoo from one of the containers, say container 14, and to dispense liquid cream rinse from the other container, say container 16. In this case, valve 30 is rotated ninety degrees from the position shwon in FIG. 1 to dispense shampoo, and valve 32 is rotated 90° from the position shown in FIG. 1 to dispense cream rinse. It will be understood that other liquids cn be dispensed from the unit if desired.

Figure 3:
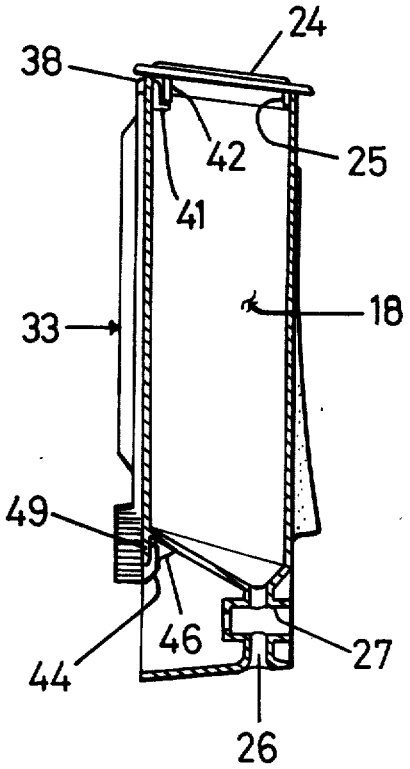
FIG. 3 is a vertical sectional view taken along line 3—3 of FIG. 2 and also showing the housing mounted on a wall bracket and with a lid affixed.
Figure 6:
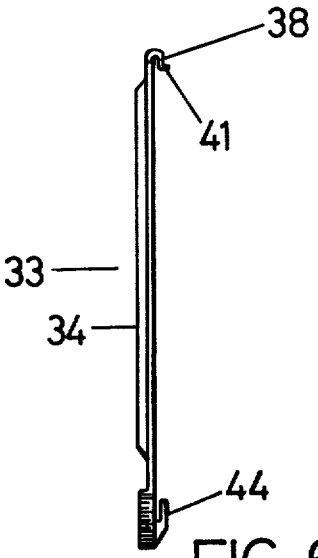
FIG. 6 is a side elevational view of the bracket of FIG. 5.
Figure 5:
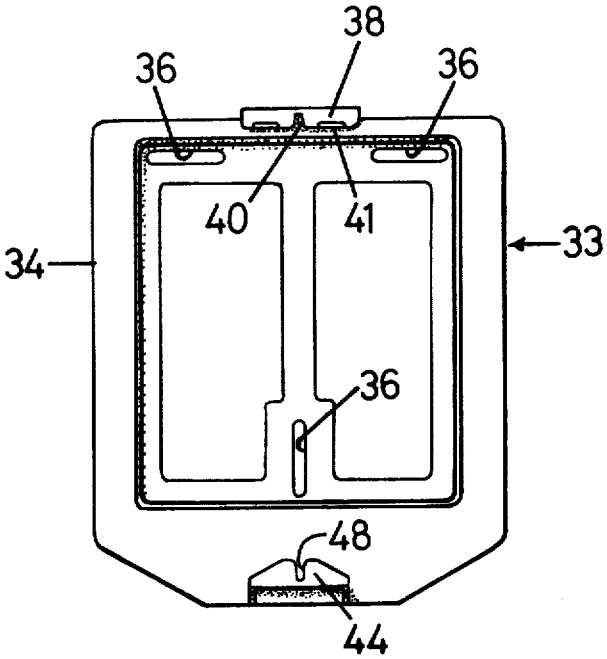
FIG. 5 is an elevational view of a wall mounting bracket included in the multiple-unit dispenser.

A wall mounting bracket 33 included in the dispenser is shown in FIGS. 5 and 6. It consists of a plastic plate 34 having elongated openings 36 to receive screws for fastening it to the wall. The plate 34 has a resilient, u-shaped, upper spring finger 38 that grasps the upper end of the housing 12 in the manner shown in FIG. 3. The spring finger 38 has a central groove 40 in the downwardly extending arm 41 that receives the partition 18. The lid 24 has a downwardly extending projection 42 that engages the spring finger 38 when the lid is on the top of the housing as shown in FIG. 3 so that the spring finger 38 cannot be released from the housing for removal of the containers 14 and 16 from the bracket 33 without first removing or opening the lid 24. The plate 34 has a lower u-shaped finger 44 for grasping a rib 46 toward the lower end of the housing 12. Finger 44 has a central groove 48 for receiving the rib 46. A downwardly extending projection 49 on housing 12 fits in the finger 44.

Figure 7:
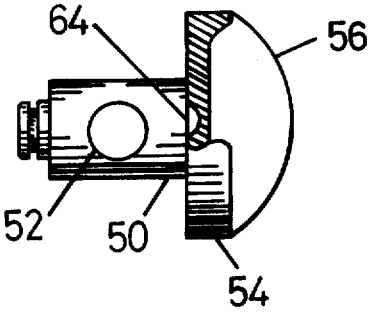
FIG. 7 is a view, partly in section, showing a rotary valve member of the dispenser.

FIG. 7 shows a valve member 50 (part of valve 30) having a central opening 52 that lines up with the opening 26 or 28 when the valve is rotated ninety degrees from the position shown in FIG. 1. The rotation of a given valve 90° opens the corresponding dispenser to dispense liquid product. When the valve 30 is in the position shown in FIG. 1, the opening 52 in member 50 is not aligned with opening 26, thus shutting off the corresponding dispenser.

Figure 9:
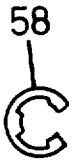
FIG. 9 shows a locking member for the valve of FIG. 7. Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.
Figure 8:
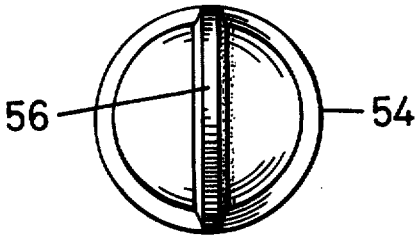
FIG. 8 is an elevational view of a knob on the valve member of FIG. 7.

A knob 54 (FIG. 8) is affixed on the valve member 50. The valve member 50 and the knob 54 are preferably made integral with each other of molded plastic, but they could be separate pieces. The knob 54 has a position indicating rib 56. A clip 58 (FIG. 9) is placed on the left end of member 50 after each valve is placed in the housing.

Figure 4:
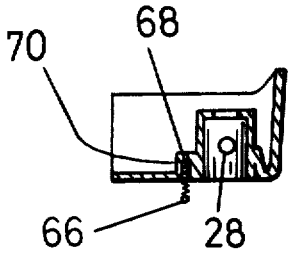
FIG. 4 is a fragmentary sectional view taken along line 4—4 of FIG. 2 and looking in the direction of the arrows.

The knob 54 has a small recess 64 that receives the ball 66 of a detent (FIG. 4). The ball 66 is biased by a spring 68 received in a recess 70. The valve member 50 is detented in the position of valve 30 shown in FIG. 1, and in this position the ball 68 fits in the recess 64.

Having thus described our invention, we claim:

1. In a multiple-unit dispenser including, at least two side-by-side containers having upper and lower ends, said containers having a pair of mouths at said upper ends for filling of said containers with liquids and a pair of openings respectively at said lower ends discharging said liquids; and valve means for said openings for opening and closing the same;

the improvement wherein:

said containers are both parts of a single, integral housing;

said valve means comprises a pair of rotary valves rotatable in said housing at said openings for opening and closing the same; and said dispenser includes a one-piece lid means removably mounted on both of said mouths for normally closing the same; and wall mounting bracket means for mounting said housing on a wall;

said bracket means having an upper portion including a U-shaped, upper spring finger for grasping said housing;

said bracket means having a lower portion including a lower finger for grasping said housing; and said lid means having a downwardly extending projection engageable with said upper spring finger for preventing release thereof without removal of said lid means from said mouths, and means for retaining said lid means laterally of said housing.

2. The dispenser as claimed in claim 1 in which:

said upper spring finger has a groove therein;

and said housing has a partition dividing the same into said pair of containers;

said partition being received in said groove.

3. The dispenser as claimed in claim 2 in which:

said housing has a lower rib; and said lower finger has a groove therein receiving said rib.

4. The dispenser as claimed in claim 3 in which:

said rotary valve means each has a detent means holding the respective valve means in a closed position.

5. The dispenser as claimed in claim 4 in which:

each of said detent means is received in said housing.

6. The dispenser as claimed in claim 5 in which:

each of said rotary valve means include a valve member having a circular rotor; and a knob on said rotor.

7. The dispenser as claimed in claim 6 in which:

said knob has a position indicating rib.

* * * * *